United States Patent [19]

Hellat et al.

[11] Patent Number: 4,781,030

[45] Date of Patent: Nov. 1, 1988

[54] DUAL BURNER

[75] Inventors: Jean Hellat, Rütihof-Baden; Jakob Keller, Dottikon, both of Switzerland

[73] Assignee: BBC Brown, Boveri & Company, Ltd., Baden, Switzerland

[21] Appl. No.: 887,194

[22] Filed: Jul. 21, 1986

[30] Foreign Application Priority Data

Jul. 30, 1985 [CH] Switzerland ..... 3289/85

[51] Int. Cl.[4] ..... F02C 1/00

[52] U.S. Cl. ..... 60/743

[58] Field of Search ..... 60/734, 736, 737, 738, 60/743, 39.06; 431/202, 268

[56] References Cited

U.S. PATENT DOCUMENTS

| | | | |
|---|---|---|---|
| 3,691,762 | 9/1972 | Ryberg et al. | 60/743 |
| 3,973,390 | 8/1976 | Jeroszico | 60/743 |
| 4,036,582 | 7/1977 | Fehler et al. | 60/743 |
| 4,050,238 | 9/1977 | Holzapfel | 60/743 |
| 4,428,191 | 1/1984 | Lane et al. . | |
| 4,455,840 | 6/1984 | Matt et al. | 60/743 |
| 4,478,045 | 10/1984 | Shekleton | 60/743 |

FOREIGN PATENT DOCUMENTS

| | | |
|---|---|---|
| 1168777 | 11/1960 | France . |
| 305072 | 1/1929 | United Kingdom . |
| 675092 | 7/1952 | United Kingdom . |
| 817936 | 8/1959 | United Kingdom . |
| 1179023 | 1/1970 | United Kingdom . |

*Primary Examiner*—Louis J. Casaregola
*Assistant Examiner*—Timothy S. Thorpe
*Attorney, Agent, or Firm*—Burns, Doane, Swecker & Mathis

[57] ABSTRACT

In the dual burner of a gas turbine or a hot gas generating system, the swirler (1) is formed from at least two doubly curved sheets (4, 5) subject to tangential air inlet (7). These sheets (4, 5) are folded along diagonals (10*a*, 10*b*) running conically outwards in the outlet flow direction. One curved fold face forms an inner cone (4*b*, 5*b*) expanding in the direction of the swirler outlet end while the other curved fold faced forms an outer cone (4*a*, 5*a*) which contracts in the direction of the end outlet. The inner cones (4*b*, 5*b*) each carry at their ends a fuel main (8) whose fuel nozzles (9) are directed radially inwards towards the inner zone of the swirler (1). The liquid fuel (2*a*, 2*b*) is directed onto the outer cone (4*a*, 5*a*), the oil film (6) forming there being "rolled in" by the air (7) flowing into the outer cone (4*a*, 5*a*).

5 Claims, 6 Drawing Sheets

DUAL BURNER

FIELD OF THE INVENTION

The present invention relates to fuel burners, and more particularly to methods and apparatus for mixing fuel and air in a burner of the dual burner type described in the preamble to claim 1.

BACKGROUND OF THE INVENTION

Because of their relatively complicated geometry, most dual burner swirlers require complicated and expensive manufacture. Particularly in premixing burners, no separation zones—due to the swirler included there as a constituent part in dual burners—must occur because such separation zones greatly increase the danger of burn-back.

A known way of constructing a separation-free swirler consists in providing a tubular shell with tangential inlet slots. This produces a free vortex which flows away axially. It is found, however, that vortex reverse flow zones (vortex breakdown) have very poor stability properties in a free vortex.

OBJECTS AND SUMMARY OF THE INVENTION

The invention is intended to remedy this difficulty. An object of the present invention is to bring about the generation of a stable vortex reverse flow zone in a dual burner of the type mentioned at the beginning.

For this purpose, it is necessary to meet conditions such that the axial profile of the vortex flow generated by the swirler must exhibit an excess velocity in the vicinity of the axis while the swirl must strongly decrease in the direction of the axis.

The object of the invention is fundamentally attained when slotted cones with appropriate semi-cone angles are provided. This provides an optimum possibility of combining the advantages of a free vortex tube with a swirler which is perfect from a fluid mechanics point of view. In this case, a vortex flow is obtained which has little swirl and an excess of axial velocity in the centre. Since the swirl speed of this burner increases strongly in the axial direction and reaches the breakdown or critical value at the end of the burner, a positionally stable vortex return flow zone is produced.

Apart from its extremely simple design which permits the production of a large number of types of vortex flow, this dual burner exhibits further advantages:

Due to the tangential air inlet into the cone, the fuel injected there is "rolled in" between relatively thin layers of air so that the generaion of strong premixing becomes superfluous.

The advantages of the premixing burner (less $NO_x$ and CO) appear. The injection momentum of the liquid fuel is selected, for full load, in such a way that the liquid fuel film penetrates to the end of an outer cone. At smaller loads, the penetration depth decreases so that the outer regions of the vortex flow remain free from fuel. This produces self-regulation which has the effect that the fuel/air mixture in the centre of the vortex is never too weak or too rich. This ensures good flame stability over a wide operating range.

There is no danger of burn-back. Scraps of flame which, due to perturbations, could reach the outer cone are immediately washed back into the inner cone by the flow.

Liquid fuels do not have to be atomised.

The construction of this dual burner is very much more compact than that of a premixing burner (no premixing section).

BRIEF DESCRIPTION OF THE DRAWING

Preferred embodiments of the invention are shown in the accompanying drawings, in which.

The flow direction of the media is indicated by arrows. The same elements are given the same reference signs in each of the various figures.

DETAILED DESCRIPTION OF THE PREFERRED EMBODIMENT

Figure 1:
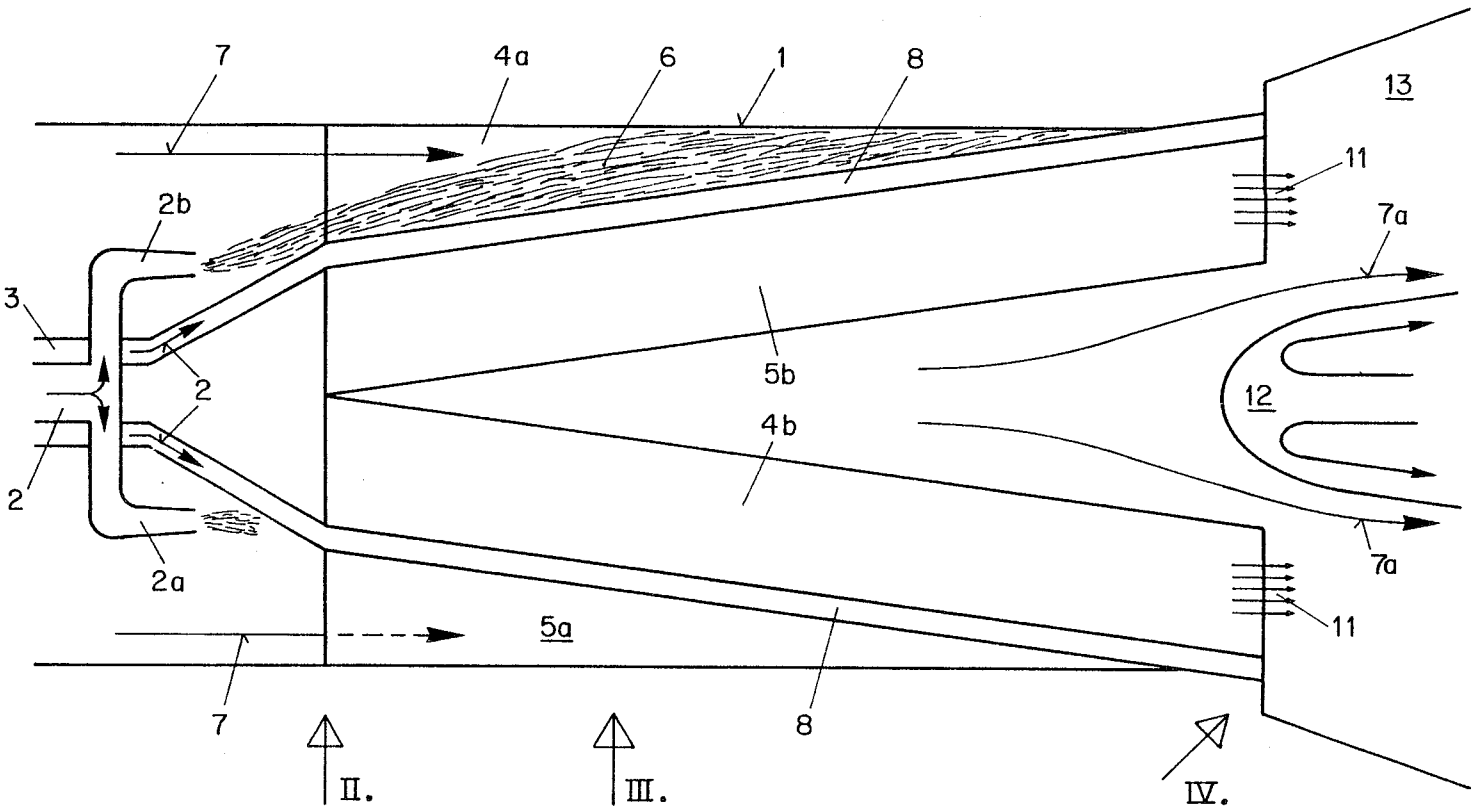
FIG. 1 is a cross-sectional view, partially schematic, of a dual burner in accordance with a first embodiment of this invention.
Figure 10:
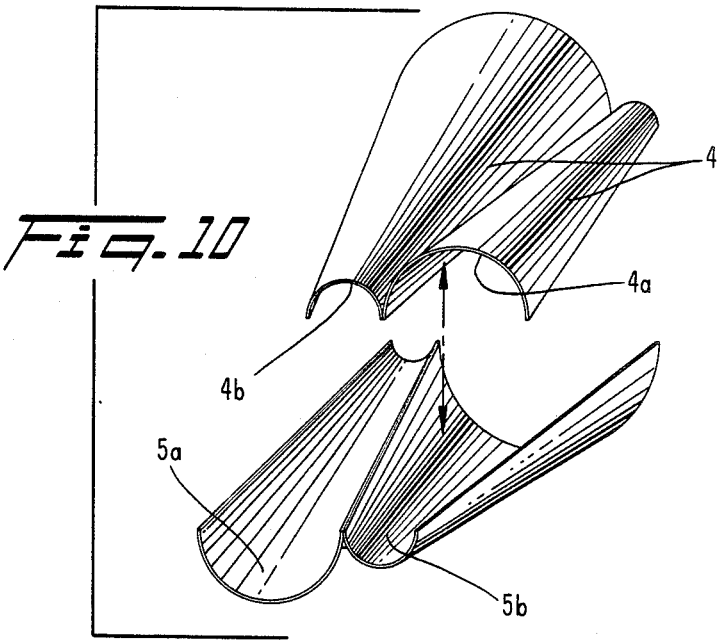
FIG. 10 is an isometric view of the upper and lower cones of the dual burner of FIG. 1.
Figure 11:
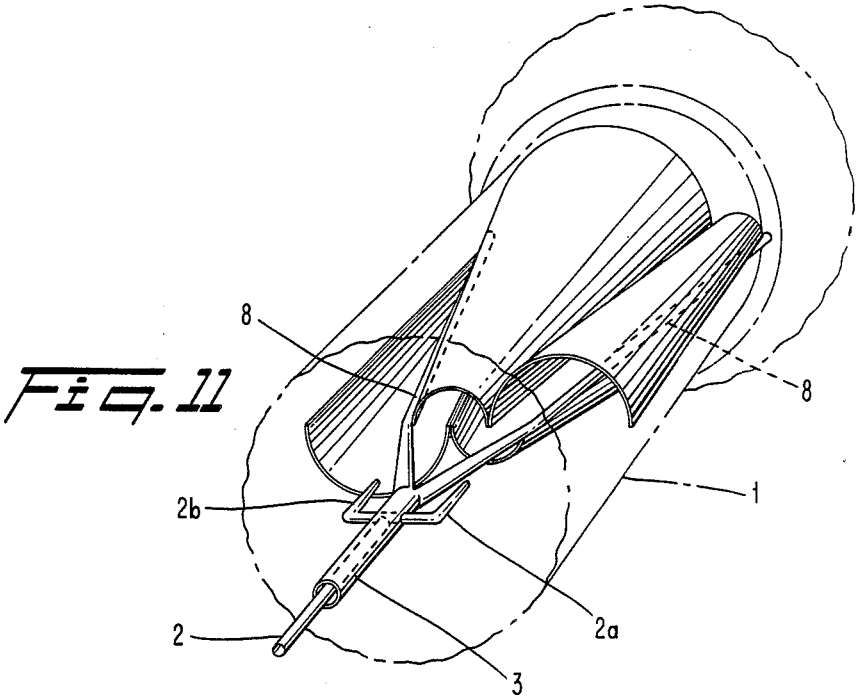
FIG. 11 is an isometric view of the dual burner of FIG. 1.

FIG. 1 shows a dual burner in the flow direction of the media coming into use there. The dual burner, which is placed upstream of the combustion space 13 of a combustion chamber, which is only indicated, consists essentially of the swirler-shaped structure, an oil main 2 and a gas main 3. The swirler structure itself consists of two doubly curved sheets, shown in isometric view in FIGS. 10 and 11, which can be produced by bending flat sheets. The sheets are folded along a particular diagonal and stiffened by a rib (see FIGS. 2, 3, 10 and 11). Since the diagonals diverge along conical lines in the central plane of the flow direction, each of them is associated with an arrangement of inner cones **4*b* and 5*b* which expand in the flow direction and an arrangement of outer cones 4*a* and 5*a*** which contract in the flow direction.

It is, of course, possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations and changes which fall within the range of the claims are intended to be embraced therein.

The fuels supplied—fuel gas and fuel oil—are introduced individually into the swirler 1 and thus satisfy the requirements to be met by a dual burner. The oil main 2 divides before the swirler 1 into two oil nozzles **2*a* and 2*b* in such a way that their injection is directed axially onto the outer cones 4a and 5a. The momentum of the oil injection at full load is selected so that the oil film 6 penetrates to the end of an outer cone 4a or 5a. At reduced load, the penetration depth is correspondingly reduced so that the outer region of the vortex flow remains free from fuel. This gives a self-regulating system which ensures that the fuel/air mixture 7a in the centre of the vortex is never too weak or too rich. The swirl strength of the vortex flow depends on the width selected for the slot which is produced between the outer cone 4a, 5a and the inner cone 4b, 5b. The outer cones 4a and 5a, which contract in the flow direction, therefore fulfil various functions. On the one hand, they act as the carrier for the oil film 6 released by the oil nozzles 2a and 2b; on the other hand, the outer cones 4a and 5a act as the flow guide for the working mixture which rolls along in the axial direction due to the swirl movement. Part of the radiant heat received by the sheet metal parts from the combustion zone 13 can here be transferred to the oil film 6. The air supplied, 7, therefore meets at least partially evaporated oil so that mixing can take place in an optimum manner. Even if parts of the oil film 6 should not be fully evaporated, this does not involve any disadvantages because the air tangentially introduced is capable of "rolling in" the residual oil film 6 in layers. The inner cones 4b and 5b, which expand in the flow direction, have fuel mains 8 (which are an extension of the gas line 3) on their sides at the end of the curvature; these fuel mains are used to supply a gaseous fuel. The fuel mains 8, which are complemented by nozzles, also act to stiffen the swirler 1. The latter is terminated at the combustion chamber end by a perforated sheet 11 through which cooling air or dilution air for the first part of the combustion chamber wall or the combustion space 13 can be supplied. The slot widths 14, not visible in FIG. 1, are selected in such a way that the reverse flow zone 12 begins at the downstream end of the inner cones 4b and 5b. For certain applications, however, it can be advantageous to select narrower air slots. In this case, the reverse flow zone 12** would be displaced upstream and the mixture would then ignite correspondingly earlier.

Since the swirl speed increases in the flow direction and the breakdown value or critical value is reached at the end of the inner cones 4b and 5b, the position of the reverse flow zone 12 is intrinsically stable. The contraction and expansion rates of the cones 4a, 5a and 4b, 5b, respectively, depend on the properties of the combustion chamber, as does the installation length of the swirler 1.

Figure 2:
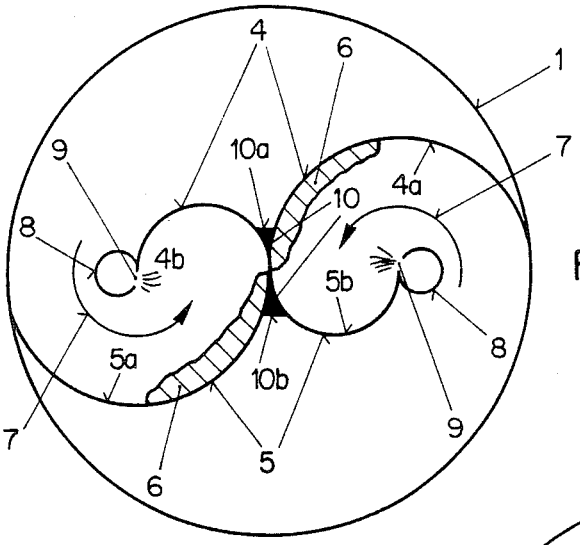
FIG. 2 is a cross-sectional view of the dual burner of FIG. 1 through the plane II in FIG. 1.
Figure 3:
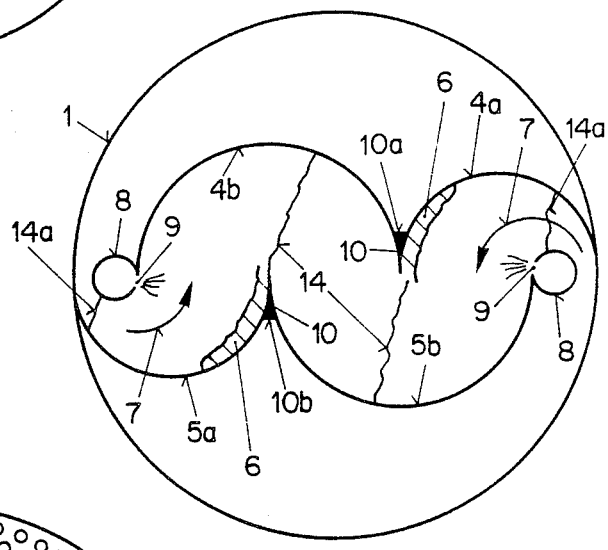
FIG. 3 is a sectional view of the dual burner of FIG. 1 through the plane of FIG. 1.
Figure 4:
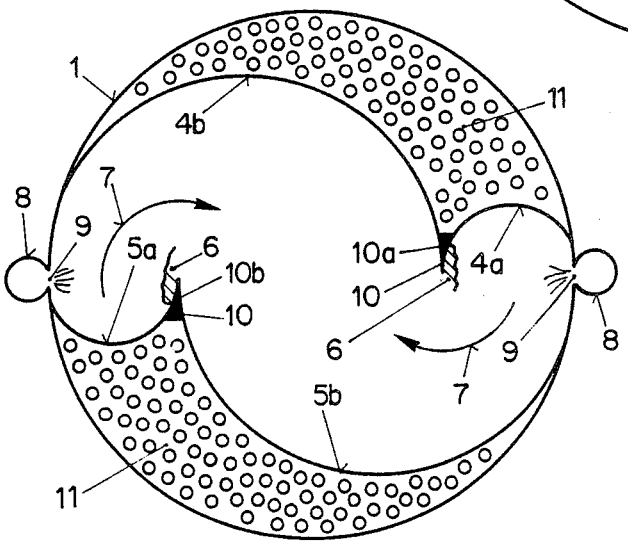
FIG. 4 is a sectional view of the dual burner of FIG. 1 through the plane IV of FIG. 1.

FIGS. 2, 3 and 4 are views through the planes II, III, and IV of FIG. 1. This makes it clear how the cones 4a, 5a and 4b, 5b respectively contract and expand. The sheets 4 and 5 are folded in the planes of the diagonals 10a and 10b and are each stiffened by a rib 10. From these figures, it is also easy to see how the air 7 flows tangentially into the cones and how the swirl motion is initiated by their curvature. The parts of the oil film 6 which do not immediately evporate are "rolled in" in layers by the swirled air 7, which ensures that the fuel/air mixture has a homogeneous concentration. The slot widths 14 between the inner and outer cones increase in the flow direction while the inlet flow openings 14a between the fuel mains 8 and the outer cones 4a and 4b decrease.

It may also be seen from these figures that the fuel mains 8 are provided with fuel nozzles 9 which inject the fuel gas towards the centre of the swirler 1. The tangentially entering air 7 is, by this means, homogeneously enriched with the fuel gas available. Here again, the fuel is "rolled in" between relatively thin air layers by the tangentially entering air 7; this makes subsequent mixing superfluous. As may be seen from FIG. 4, the swirler 1 is terminated at the combustion chamber end by the perforated sheet 11 through which, as already explained, cooling air or dilution air reaches the combustion space 13.

Figure 5:
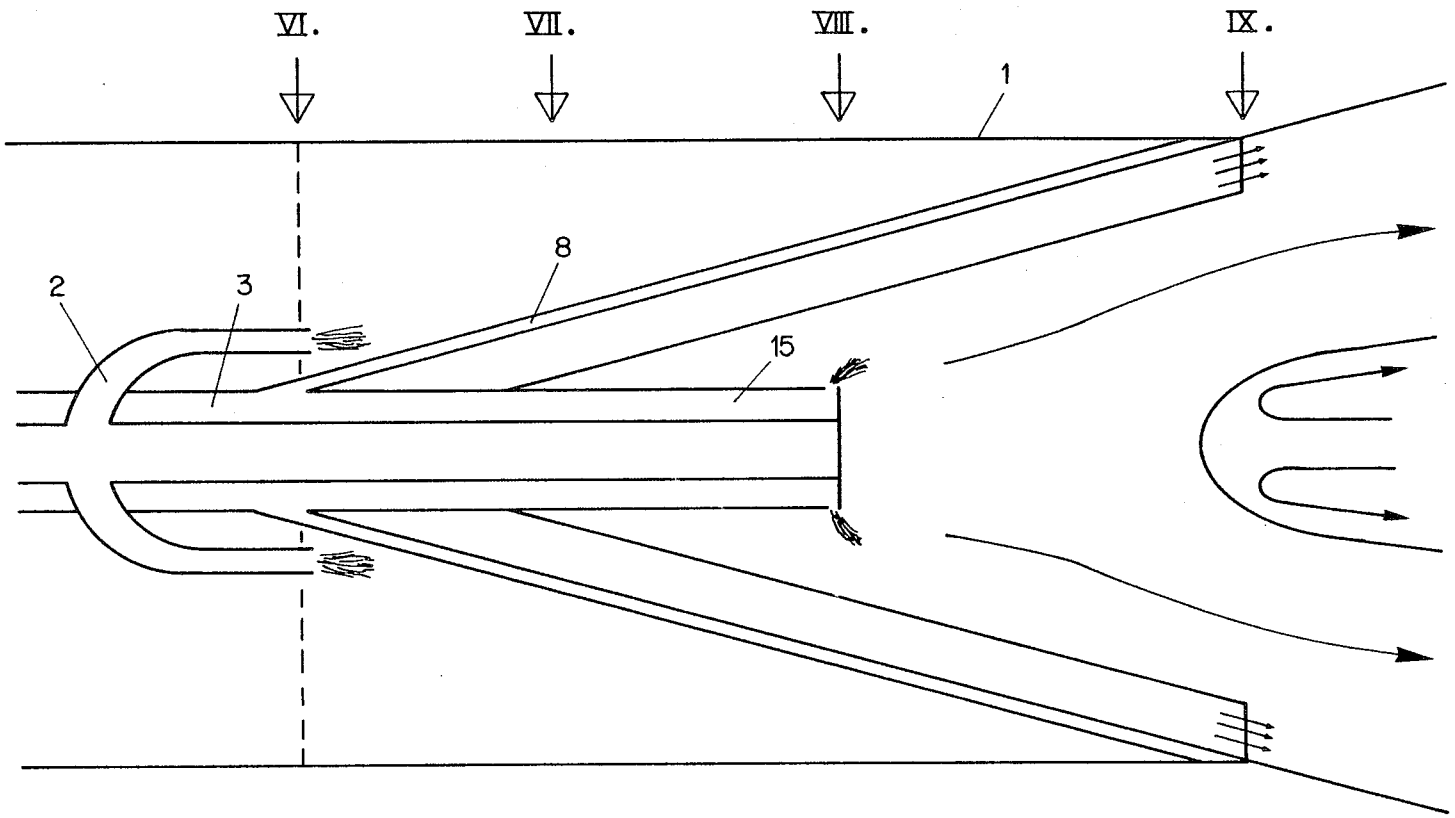
FIG. 5 is a cross-sectional view, partially schematic of a further embodiment of the dual burner.
Figure 6:
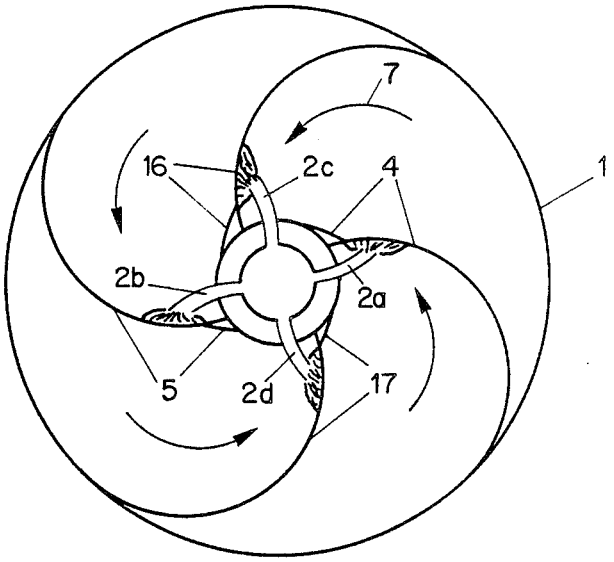
FIG. 6 is a sectional view of the dual burner of FIG. 5 through the plane VI of FIG. 5.
Figure 7:
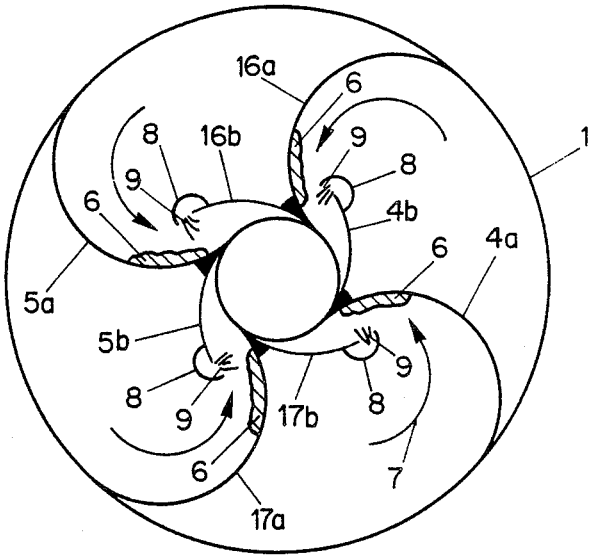
FIG. 7 is a sectional view of the dual burner of FIG. 5 through the plane VII of FIG. 5.
Figure 8:
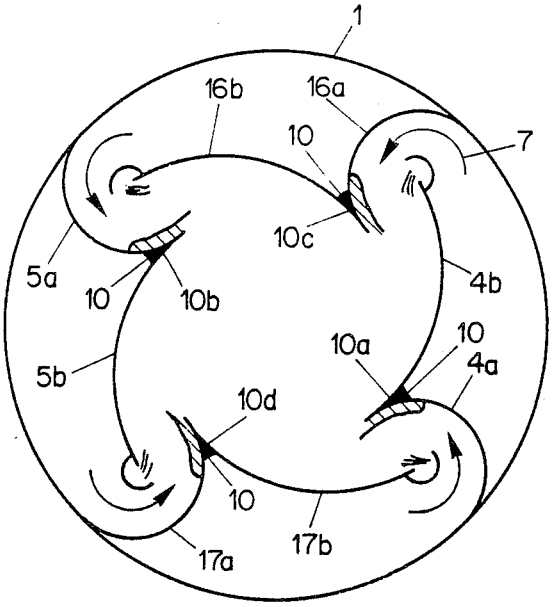
FIG. 8 is a sectional view of the dual burner of FIG. 5 through the plane VIII of FIG. 5.
Figure 9:
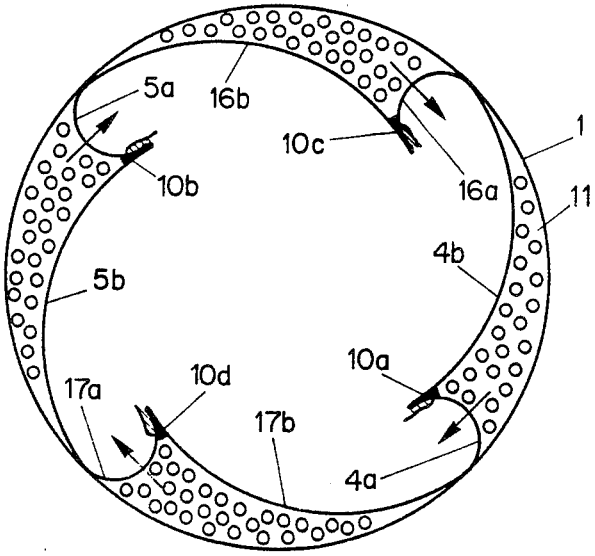
FIG. 9 is a sectional view of the dual burner of FIG. 5 through the plane IX of FIG. 5.

FIG. 5 shows an extended variant of the swirler 1 already shown in FIG. 1. This arrangement is supplemented by a pilot burner 15. For this purpose, the gas main 3 is extended by the fuel mains 8 in the flow direction. The pilot burner arrangement is particularly suitable where the swirler 1 has more than two pairs of cones.

As may be seen from FIGS. 6, 7, 8 and 9—which are views through the planes VI, VII, VIII and IX of FIG. 5—the swirler 1, constructed from four pairs of cones in this case, does not differ in concept from the variant already described consisting of two pairs of cones. The mixing of the fuels with the tangentially entering air 7 is simpler to arrange in this case because this arrangement has smaller amounts of fuel to "roll in" at one time. The injection of the fuel via the four oil nozzles 2a, 2b, 2c and 2d is axially directed onto the outer cones 4a, 5a, 16a and 17a in this case also. The swirler 1 now consists of four double curvature sheets 4, 5, 16 and 17 which are folded to give double cones in the planes of the diagonals 10a, 10b, 10c and 10d. These diagonals run conically outwards in the flow direction so that the outer cones 4a, 5a, 16a and 17a contract while the inner cones 4b, 5b, 16b and 17b expand. The inner cones 4b, 5b, 16b and 17b each have a fuel main 8 provided with fuel nozzles 9 at their ends and these, in conjunction with the rib 10, serve to increase the stiffness of the folded sheets 4, 5, 16 and 17.

At the combustion chamber end, the remaining opening of the swirler 1 is terminated by a perforated sheet 11. The mode of operation of this extended swirler 1 does not differ from that of the arrangement of the swirler explained in FIGS. 1, 2, 3 and 4.

We claim:

1. In a dual burner for generating hot gas of the type having supply systems for air and gaseous liquid fuels, and a swirler assembly, the improvement comprising:

a swirler assembly having an inlet end and an outlet end and including at least two doubly curved sheets folded along diagonal lines extending conically outward toward said outlet end, each of said doubly curved sheets having first and second curved fold faces, said first fold face forming an internal core which expands in the direction of said outlet end, and said second curved fold face forming an external core which contracts in the direction of said outlet end, said first curved fold having an edge extending in the direction of said outlet end, fuel mains extending along said first curved fold face edges, said fuel mains being provided with fuel nozzles, and a tangential air inlet extending along said inlet end.

2. The dual burner according to claim 1, wherein said fuel nozzles are directed radially inwardly in said swirler.

3. The dual burner according to claim 1, further comprising a pilot burner located centrally relative to said doubly curved sheets.

4. The dual burner according to claim 1, wherein a cross-sectional area is defined at said outlet end between an outer contour of the swirler and said internal cones and a perforated sheet extends over said area.

5. The dual burner according to claim 1, wherein said folds along said diagonal lines are stiffened by a rib.

* * * * *